US007790100B2

(12) United States Patent
Scheffler et al.

(10) Patent No.: US 7,790,100 B2
(45) Date of Patent: Sep. 7, 2010

(54) ANNEALING RACK

(75) Inventors: Martin Scheffler, Aachen (DE); Gerd Faymonville, Simmerath (DE); Helmuth Packes, Embrach (CH)

(73) Assignee: Otto Junker GmbH, Simmerath/Lammersdorf (DE)

( * ) Notice: Subject to any disclaimer, the term of this patent is extended or adjusted under 35 U.S.C. 154(b) by 682 days.

(21) Appl. No.: 10/550,706

(22) PCT Filed: Mar. 31, 2004

(86) PCT No.: PCT/EP2004/003396

§ 371 (c)(1),
(2), (4) Date: Jun. 27, 2007

(87) PCT Pub. No.: WO2004/087969

PCT Pub. Date: Oct. 14, 2004

(65) Prior Publication Data

US 2007/0267788 A1 Nov. 22, 2007

(30) Foreign Application Priority Data

Apr. 3, 2003 (DE) ..... 103 15 354

(51) Int. Cl.
*C21B 3/00* (2006.01)

(52) U.S. Cl. ..... 266/274; 432/261

(58) Field of Classification Search ..... 266/274; 432/261

See application file for complete search history.

(56) References Cited

U.S. PATENT DOCUMENTS

| | | | | |
|---|---|---|---|---|
| 1,854,179 A | | 4/1932 | Chapin | |
| 2,430,521 A | * | 11/1947 | McCormick | 432/261 |
| 2,807,454 A | * | 9/1957 | Beadle | 432/261 |
| 2,962,273 A | | 11/1960 | Moore | |
| 3,642,263 A | * | 2/1972 | Pine et al. | 432/261 |
| 4,290,753 A | * | 9/1981 | Klefisch | 432/261 |
| 6,558,615 B1 | * | 5/2003 | Jungblut | 266/274 |

FOREIGN PATENT DOCUMENTS

| | | |
|---|---|---|
| DE | 72 17 903 | 5/1972 |
| DE | 30 11 114 A1 | 10/1981 |
| DE | 32 17 794 A | 11/1983 |
| DE | 34 44 507 A | 6/1986 |
| DE | 198 30 485 A | 1/2000 |
| EP | 0 012 853 | 11/1979 |

(Continued)

OTHER PUBLICATIONS

International Search Report for PCT/EP2004/003396 (in German), Mar. 2004.

(Continued)

*Primary Examiner*—Scott Kastler
(74) *Attorney, Agent, or Firm*—Proskauer Rose LLP

(57) ABSTRACT

Disclosed is an annealing frame, especially for conveying molded aluminum parts during a heat treatment process. The invention is characterized in that said annealing frame comprises at least one annealing frame element (1) that is provided with at least one annealing basket (13) which can be placed therein and can be adapted to the annealing material. Annealing material having the most different shapes can be accommodated in a non-tipping and slip-proof manner in said annealing basket (13) while being conveyed during the thermal treatment process.

15 Claims, 8 Drawing Sheets

FOREIGN PATENT DOCUMENTS

| | | |
|---|---|---|
| EP | 0 997 541 | 3/2000 |
| EP | 1 124 997 B | 11/2002 |
| GB | 1 206 576 | 9/1976 |
| WO | 95/23771 A | 8/1995 |
| WO | 00/24942 | 4/2000 |

OTHER PUBLICATIONS

International Preliminary Examination Report for PCT/EP2004/003396 (in German), Mar. 2004.

* cited by examiner

DETAIL W

DETAIL X

DETAIL Y

DETAIL Z

ANNEALING RACK

CROSS-REFERENCE TO RELATED APPLICATIONS

This application is a National Phase Application of International Application No. PCT/EP2004/003396, filed on Mar. 31, 2004, which claims the benefit of and priority to German patent application no. DE 103 15 354.3-24, filed on Apr. 3, 2003.

BACKGROUND OF THE INVENTION

Description

The present invention relates to an annealing rack, particularly for transporting aluminum cast parts in the heat treatment process.

Annealing racks for transporting annealing stock through an annealing furnace and also for quenching the annealing stock in quenching liquid are subjected to large temperature variations and local temperature differentials, so that they suffer large thermal tensions. When an annealing rack filled with annealing stock enters a furnace, the upper edge of the annealing rack heats up first, while the side walls and the floor are initially kept cold by the annealing stock. Due to the varying heating, warping and fractures of the annealing rack occur.

A method for annealing and internal rinsing of copper pipe coils, the copper pipe coils being positioned in annealing racks stacked one on top of another as they pass through an annealing furnace, is known from DE 198 304 85 A 1. The stacking and unstacking of the annealing racks is possible completely automatically. Detachable connections between individual parts of the annealing racks are not cited. With permanent connections, the danger exists of permanent bending, and in the worst case even a fracture. Securing the annealing product in the annealing rack is not provided. If the annealing rack bends, the annealing stock may thus shift or even tip over.

A transport basket for annealing stock in roller hearth furnaces, having a multipart floor made of multiple lattice grates lying next to one another, which are connected to one another in an articulated way having slight angular mobility through bolts, and having front and side walls which are connected permanently to the floor and are connected to one another with expansion mobility through profile clamps, is known from DE 344 45 07 C2. This transport basket is laid directly on the hearth rollers and is carried along by them.

In this case, the disadvantage is that the annealing stock may shift or tip over in such transport baskets during transport and may thus incur damage. The side plates are permanently connected to the lattice grates, particularly welded. Permanent bending and possibly even fracture may occur in this region. This may also cause shifting or tipping over of the annealing stock. Transport baskets bent in this way may not be stacked. Such stacking is also not provided.

SUMMARY OF THE INVENTION

The present invention is therefore based on the object of designing an annealing rack of the type cited, for the transport of aluminum cast parts in the heat treatment process in particular, in such a way that annealing stock of greatly varying forms is secured therein so it is safe from tipping and slipping during the conveyance.

The object is achieved in an annealing rack of the type cited at the beginning in that it is constructed from at least one annealing rack element having at least one annealing basket, which may be placed therein and is adaptable to the annealing stock.

By dividing the annealing rack into annealing rack element (s) and, in addition, annealing basket(s), stock to be annealed may be placed securely in the annealing basket in a simple way and may then be placed with this basket in the annealing rack element. With heavier stock, the basket is first placed in the annealing rack element and subsequently filled. In additionally, using two or more annealing baskets per annealing rack element is also conceivable.

The above-mentioned division allows the annealing rack element to be produced from very stable material in a simple basic shape. The annealing baskets are then to be designed individually for the particular stock to be transported for secure transport while avoiding shifting or tipping over of the annealing stock. A less stable material may be selected for the baskets than for the annealing rack elements. An annealing rack which is assembled from multiple annealing rack elements may thus receive annealing baskets of greatly varying design for the secure transport of annealing stock of greatly varying construction for simultaneous or sequential annealing processes.

Preferred implementations are considered in the subclaims.

The annealing rack according to the present invention may be implemented in such a way that the annealing rack elements are stackable one on top of another. The height of the annealing rack may thus be oriented to the quantity of the stock to be annealed.

Furthermore, the annealing rack according to the present invention may be implemented in such a way that every annealing rack element has at least one rest and corner supports projecting upward from the corners of the rest. A centering aid, particularly a cone-taper connection, is conceivable for stacking the annealing rack elements, the end of the corner supports distal from the rest surface being provided as a cone and the end located on the support being provided with a receiving taper. Secure stacking and unstacking is thus made possible. In addition, slipping and upsetting of the stacked annealing rack elements in the event of dynamic loads during the transport is prevented.

The floor may also be implemented in multiple parts, of course. It may then be constructed depending on the space required. The floor may have a closed surface, but grating or frame floors are preferred. In this case, perforated hollow profiles are preferably used for the frames.

In a further embodiment, the corner supports may be connected to the rest and/or to one another using rack struts in at least one of the annealing rack elements. The rack struts cause stabilization of the corner supports and may prevent slipping of the annealing basket. The rack struts may, for example, be flat steel.

In a further implementation of the annealing rack according to the present invention, the rest, the corner supports, and possibly the rack struts of the annealing rack element are detachably connected to one another, particularly by plug-in connections. Through the detachable connections, all dynamic and thermal loads arising during transport through the annealing furnace may be absorbed without resulting in permanent deformation. For this purpose, the connections are preferably to be implemented having a slight play. After the quenching in the water bath, there is no permanent distortion of the annealing rack elements. The annealing rack element according to the present invention is therefore suitable for passing through the heat treatment process frequently. The individual components may be replaced easily. The storage costs are reduced, since the annealing rack elements in the disassembled state and individual replacement parts may be stored laid together flat.

Furthermore, the annealing rack according to the present invention may be implemented in such a way that at least one of the annealing rack elements is provided with means for detachable fixing of the annealing basket. In this way, slipping of the annealing basket on the rest of the annealing rack element, particularly in the event of strong dynamic loads, is suppressed and/or reduced. Depressions in the rest of the particular annealing rack element, in which legs of the basket floor or the entire floor surface of the annealing basket may be placed, are particularly conceivable.

Furthermore, the annealing rack according to the present invention may have an annealing basket in which the basket floor is implemented having basket supports projecting upward. The components to be annealed are placed on the basket floor. The basket supports support the components somewhat in this case. They may be positioned on the basket floor as a function of the shape and number of the components. The basket supports are preferably hollow profiles, particularly perforated hollow profiles. The basket floor may also be produced from perforated hollow profiles and implemented as a frame or grating, for example.

The annealing rack according to the present invention may also have basket struts, the basket supports being connected to the basket floor and/or to one another using the basket struts in at least one of the annealing baskets. In this case, the basket floor and the basket supports and possibly the basket struts may be connected to one another detachably, particularly by plug-in connections. The connections of basket floor, basket supports, and possibly basket struts are preferably to be implemented having a slight play. Permanent distortion in the heat treatment process is thus avoided. The basket struts not only stabilize the basket supports, but rather may additionally also support the components to be annealed. In this case, they may also be attached at different points as needed. The basket struts are preferably produced from flat steel or perforated hollow profiles.

Furthermore, in the annealing frame according to the present invention, wire clips may be detachably attached to the basket floor and/or the basket supports and/or the basket struts. These wire clips may particularly be plugged in and/or screwed in. These wire clips are ideal for especially complex aluminum components, as are used in the automobile industry, for example. The individual annealing stock may be removed easily during the automatic loading and unloading procedure, since it is centered by the wire clips. In this case, the wire clips may be plugged into prefabricated holes in the basket floor and/or the basket supports and/or the basket struts, and they may additionally be fixed using a nut for security. The wire clips generally only assume a centering function, while in contrast the remaining parts of the annealing basket are to be implemented as more stable. The annealing rack element is to be implemented as the most robust.

Finally, in the annealing rack according to the present invention, at least one of the annealing baskets may be provided with means for detachable fixing on the annealing rack. The annealing basket may thus be attached to the annealing rack element and removed again easily.

BRIEF DESCRIPTION OF THE DRAWINGS

The present invention will be explained in greater detail on the basis of the following exemplary embodiment.

DETAILED DESCRIPTION OF THE INVENTION

Figure 1:
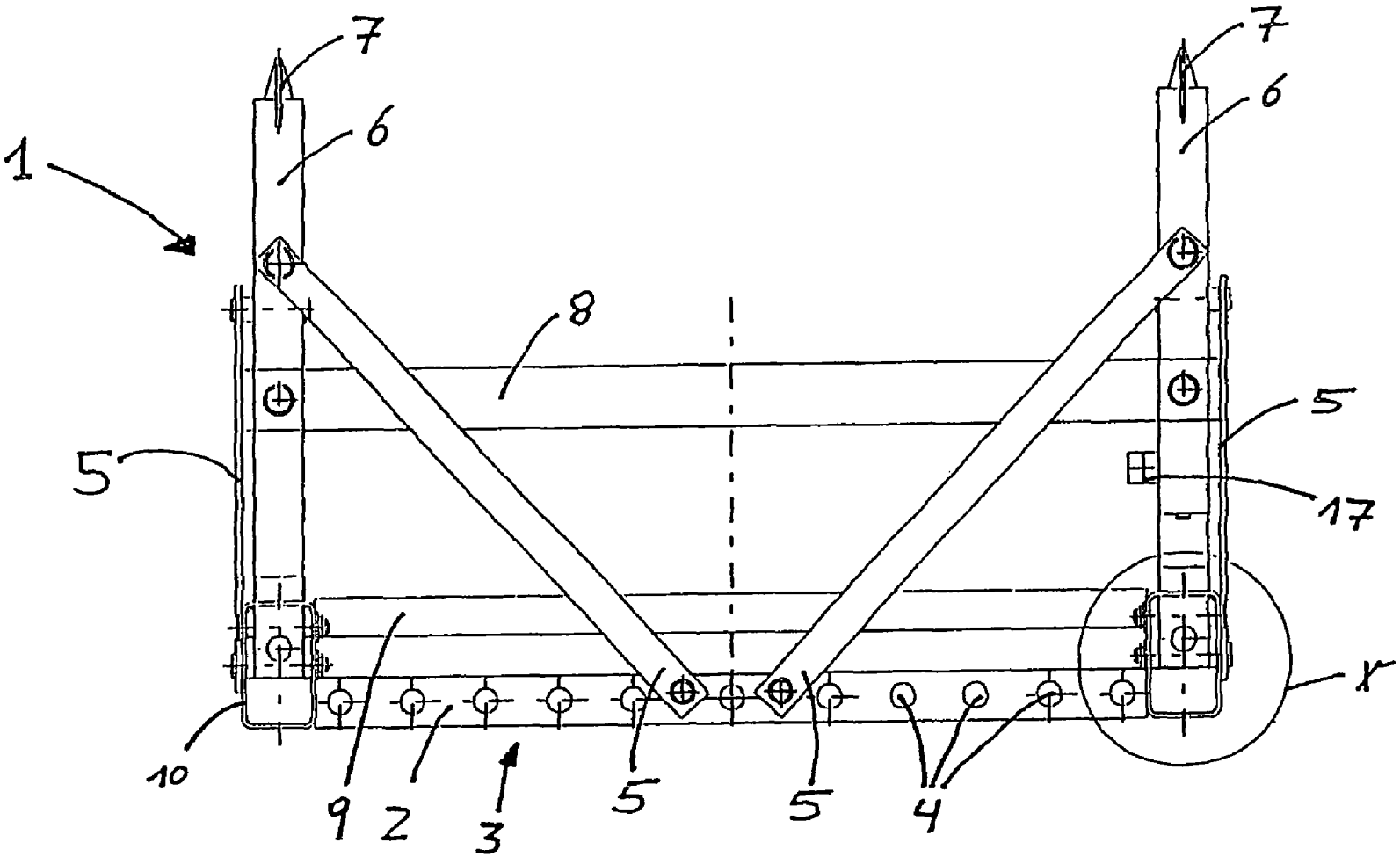
FIG. 1 shows a front view of an embodiment according to the present invention of an annealing rack element.
Figure 2:
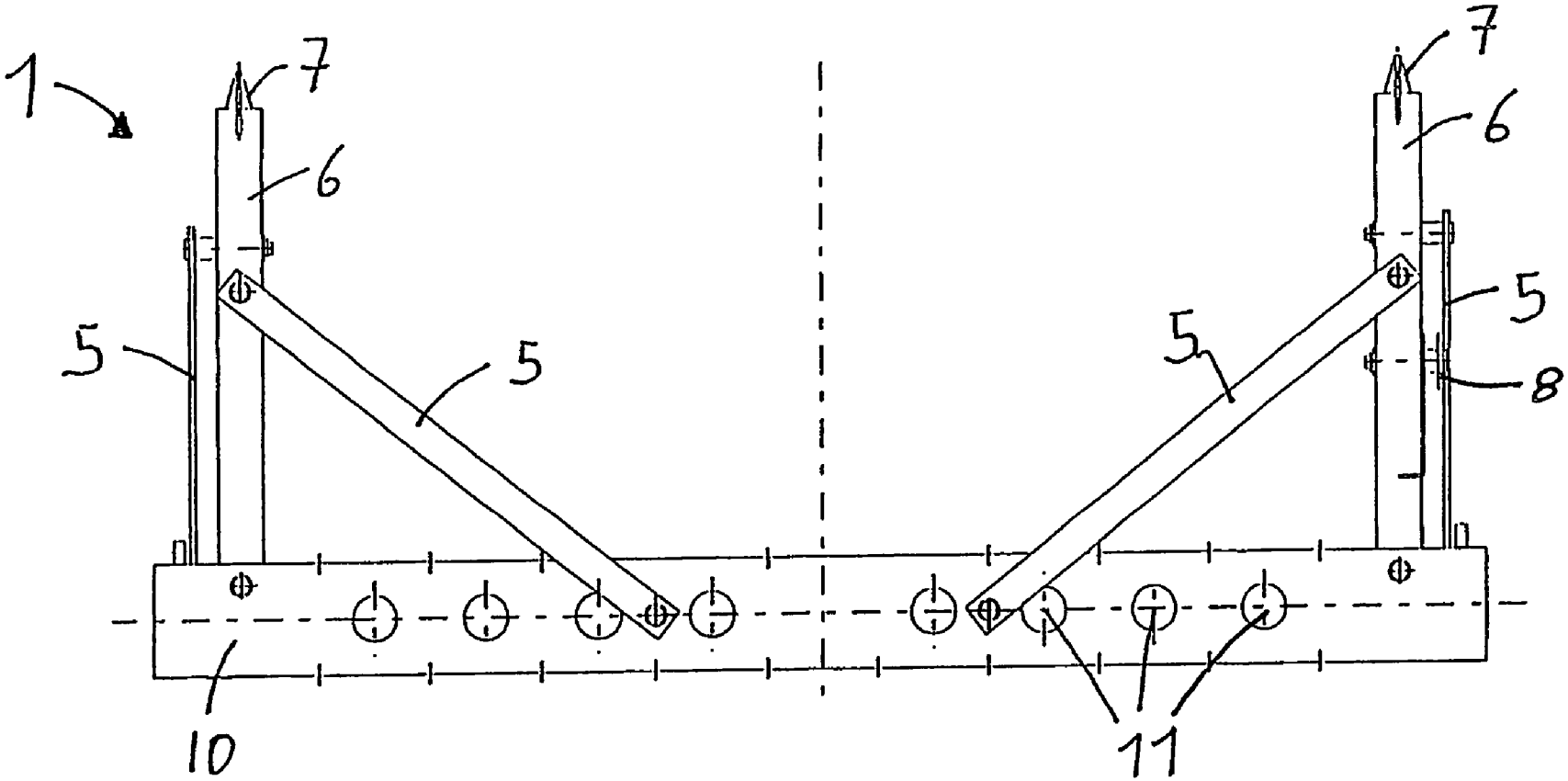
FIG. 2 shows a side view of the annealing rack element according to FIG. 1.
Figure 3:
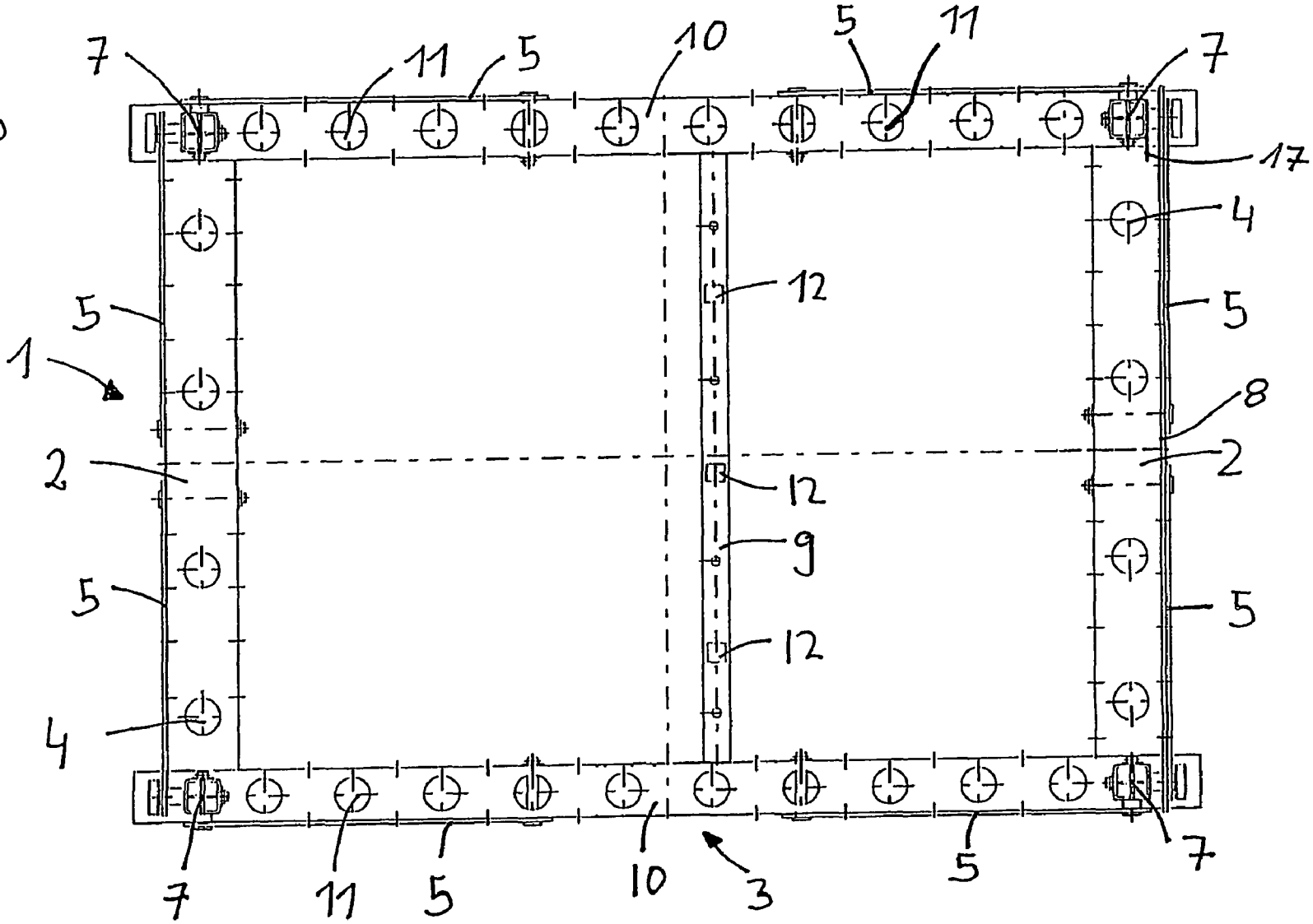
FIG. 3 shows a top view of the annealing rack element according to FIG. 1.

FIGS. 1-3 show an annealing rack element 1 in front and side views and a top view.

The front view according to FIG. 1 shows a short, horizontal, hollow rest profile 2 as a part of the rest 3, which has multiple holes 4 and is connected via rack struts 5 to corner supports 6. All hollow profiles, i.e., annealing rack elements and baskets, used in the annealing rack are preferably those having high geometrical moments of inertia. In addition, preferably all hollow profiles are selected having identical wall thicknesses in order to avoid different temperature profiles during the quenching procedure. Only some of the holes 4 are provided with reference numbers. Accelerations and inertial forces may be absorbed better through the diagonally running rack struts 5. The corner supports 6 are connected at their lower end to the rest 3 and have a centering tip 7 at their upper end. When multiple annealing rack elements 1 are stacked one on top of another, the centering tips 7 of the particular lower annealing rack element 1 engage in corresponding recesses of the rest 3 of the particular upper annealing rack element 1. These recesses are not shown. The centering aids 7 allow secure stacking and unstacking. In the event of dynamic loads during the transport, slipping and upsetting of the stacked annealing rack elements 1 is prevented.

A transport switching flag 8 in the form of an oblong sheet is positioned between two corner supports 6. This transport switching flag 8 is also detachably attached using bolts and cotter pin. It is detected by light barriers (not shown) and the position of the annealing rack is detected for the process controller on the basis of this. For precise identification of an annealing rack, an identification switching flag 17 is attached to one of the corner supports 6, from which the details on each of the individual annealing racks and/or the annealing stock transported therein are readable. The function of the positioning profile 9 illustrated is explained in the following for FIG. 3.

The side view shown in FIG. 2 shows a long horizontal rest profile 10 having holes 11 as a part of the rest 3, as well as rack struts 5 and corner supports 6 having centering aids 7. The long rest profile 10 has a greater height than the short rest profile 2. Only some of the holes 11 are provided with reference numbers.

In the top view shown in FIG. 3, the construction of the rest 3 having two short rest profiles 2 and two long rest profiles 10 may be seen. Only some of the holes 4 and 11 are marked with reference numbers. Four corner supports 6 having centering aids 7 are located in the four corners of the rest 3. The long rest profiles 10 are connected to one another via the positioning profile 9. The positioning profile 9 has three square holes 12. As may be seen from FIGS. 5 and 10, the basket supports 18 are inserted into the square holes 12. More detailed explanations in this regard are in the following descriptions of the corresponding figures.

Figure 4:
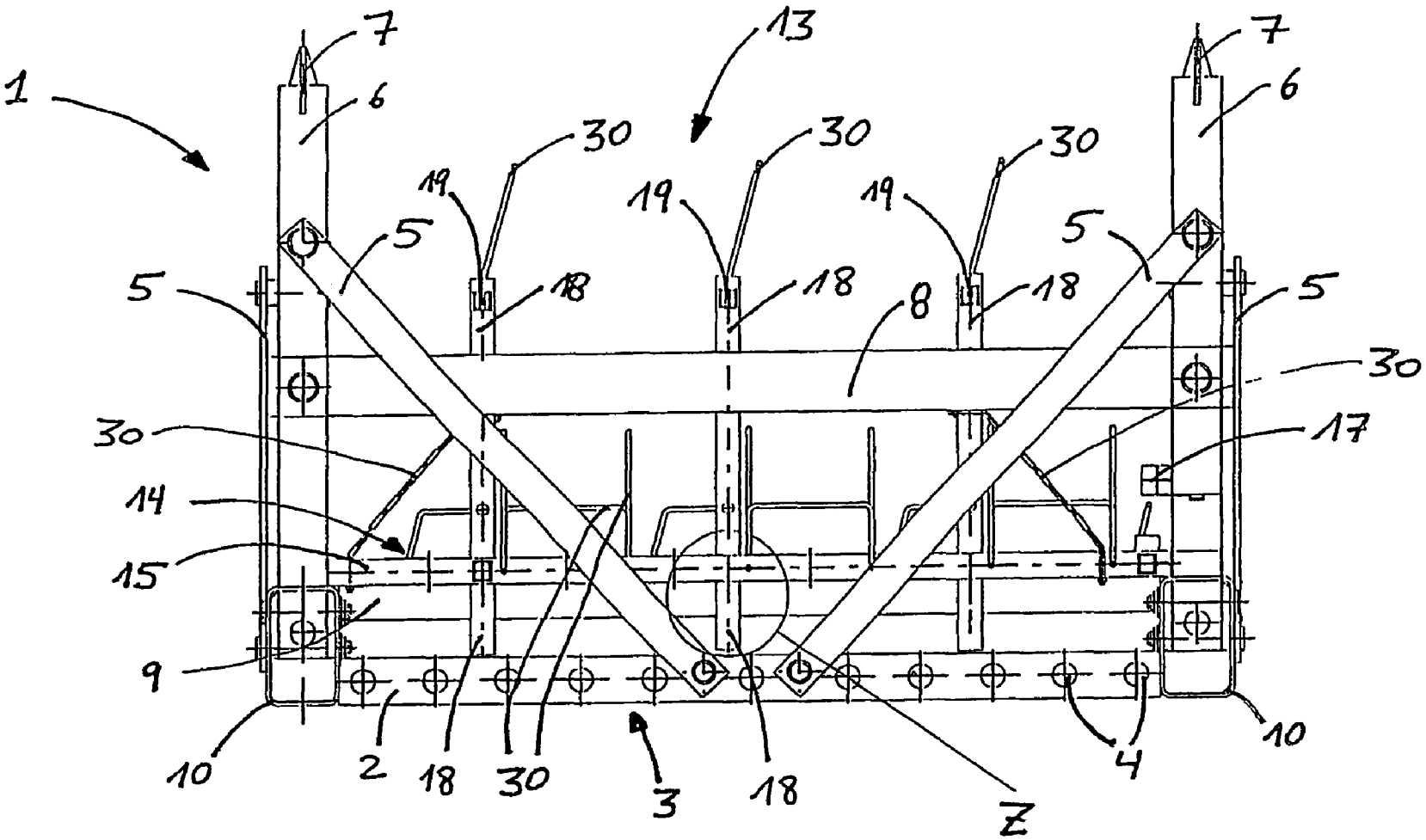
FIG. 4 shows a front view of the annealing rack element according to FIG. 1 having inserted annealing basket.
Figure 5:
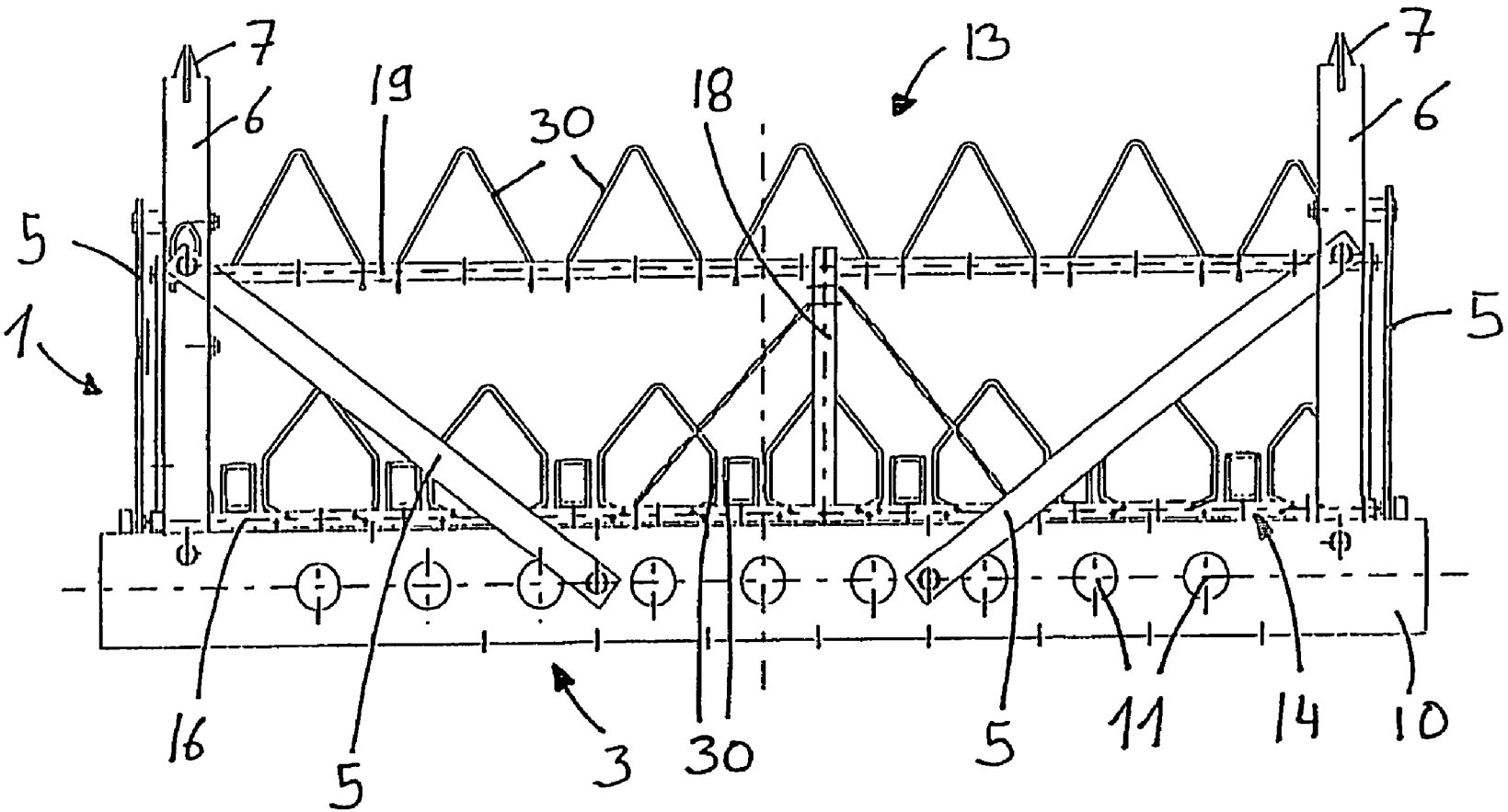
FIG. 5 shows a side view of the annealing rack element according to FIG. 2 having inserted annealing basket.
Figure 6:
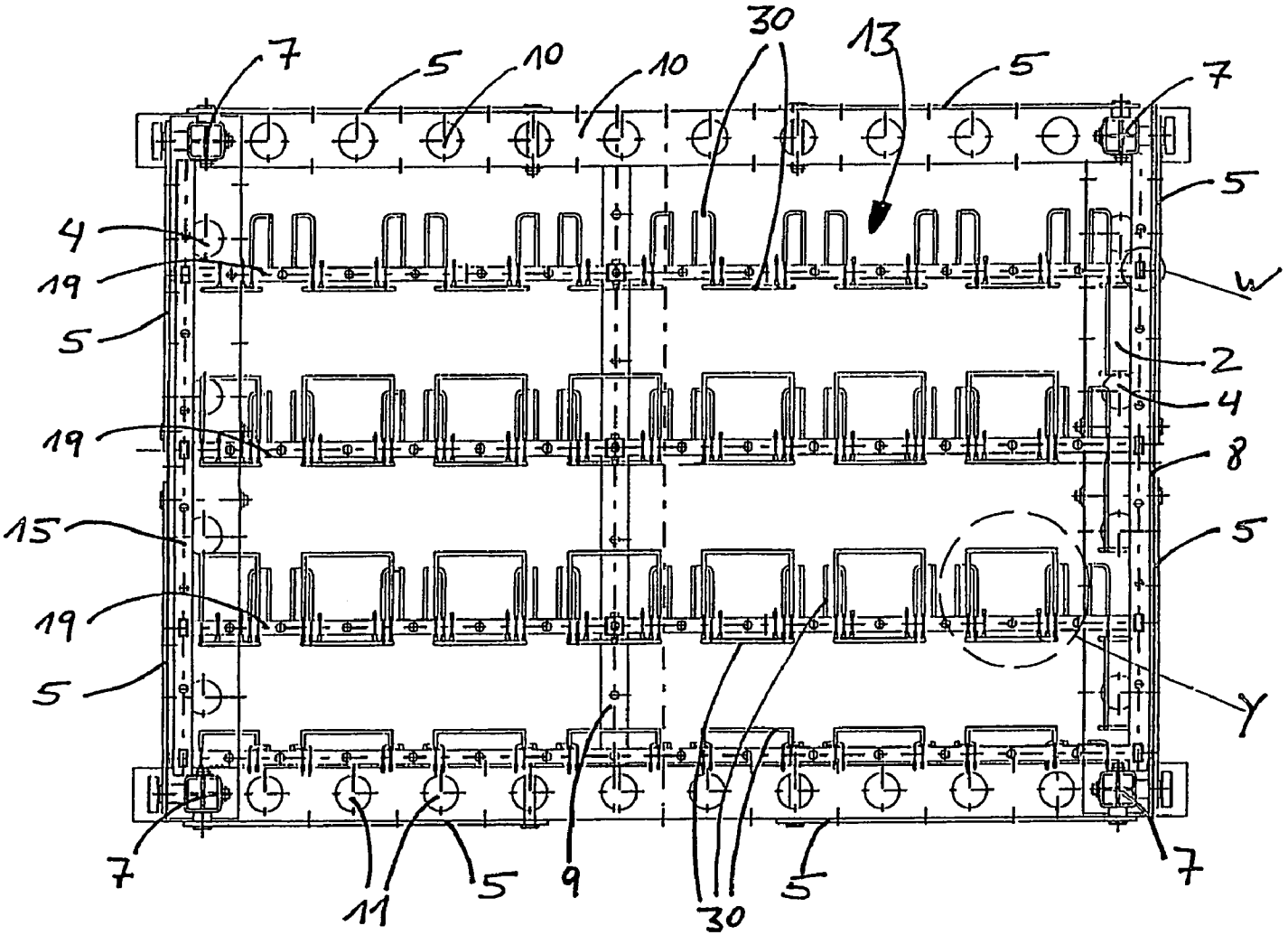
FIG. 6 shows a top view of the annealing rack element according to FIG. 3 having inserted annealing basket.

FIGS. 4 through 6 correspond to FIGS. 1 through 3. They additionally have an annealing basket 13 which is inserted into an annealing rack element 1. The basket floor 14 comprises two short floor profiles 15, which are positioned parallel and at a distance to one another and between which four long floor profiles 16 are positioned. The long floor profiles 16 lie on the shorter rest profiles 2 and the positioning profile 9. In this case, the positioning profile 9 is not only used for laying down the annealing basket 13. The three square holes 12 additionally allow the passage of three basket supports 18 of the annealing basket 13. These basket supports 18 and the positioning profile 9 are implemented as hollow profiles. The basket supports 18 are fixed solely by gravity in the square holes 12. The annealing basket 13 may be raised easily out of the annealing rack element 1 after the heat treatment process. Upwardly projecting basket supports 18 are positioned on the basket floor 14. The basket supports 18 are connected to one another via basket struts 19, the long basket struts 19 covering the long floor profiles 16 in the top view shown in FIG. 6.

Since the rest 3, the corner supports 6, and the rack struts 5 of the annealing rack elements 1, and the basket floor 14, the basket supports 18, and the basket struts 19 of the annealing basket 13 are all produced either from multiply perforated hollow profiles of identical wall thickness or from flat steel, the annealing stock may be cooled rapidly and uniformly during the quenching process. The flat steel cools down rapidly upon contact with cold water and the coolant liquid, usually water, may additionally penetrate extremely rapidly into the hollow profiles through the multiple holes in the hollow profiles. In this case, the selection of identical wall thicknesses encourages uniform cooling.

The wire clip shown will be discussed in greater detail in FIG. 9.

Each part may be replaced individually as needed through the plug-in connections and/or screw connections. No complete annealing rack elements 1 have to be kept ready. A small reserve is completely sufficient, this only occupying a small space in the disassembled state.

Figure 7:
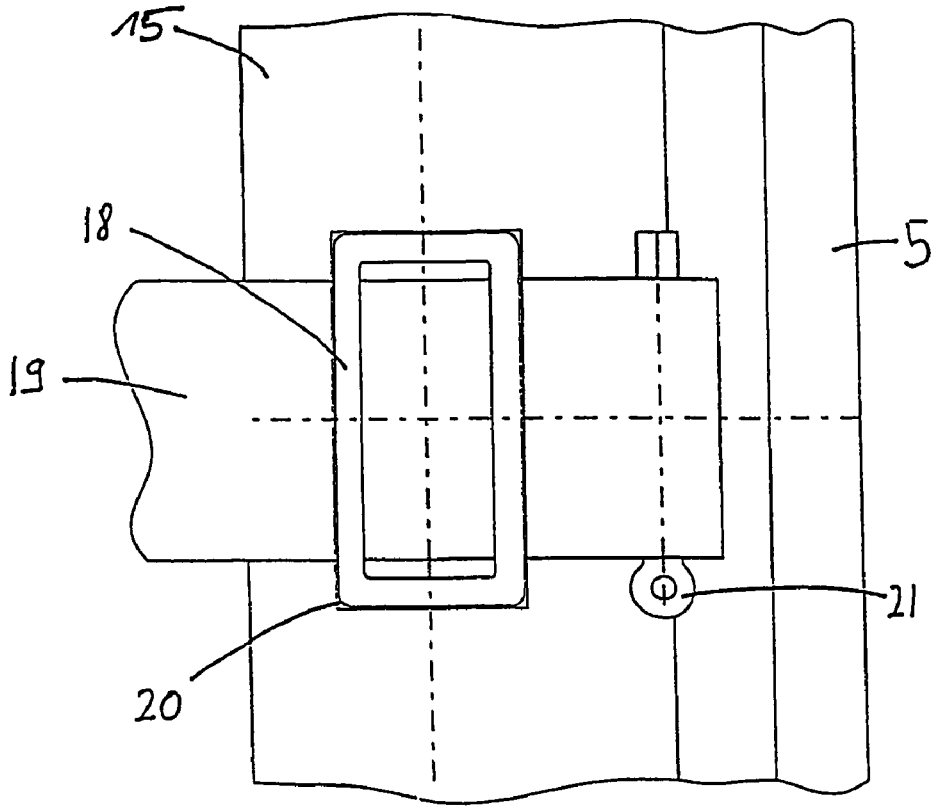
FIG. 7 shows a detail view w of the plug-in connections basket struts/basket supports of the annealing basket.

The detail w from FIG. 6 is shown enlarged in FIG. 7. In this case, the plug-in connection of three parts of the annealing basket 13 is shown. Using this plug-in connection, a short floor profile 15 is detachably connected to a long basket strut 19 running perpendicularly thereto and, in addition, to a basket support 18, which projects upward perpendicularly from the basket floor 14.

For this purpose, the short floor profiles 15 have a rectangular hole 20, into which the lower end of the upwardly projecting basket support 18 is inserted with play. This basket support 18 is drilled through above its insertion region and the long basket strut 19 is inserted through this hole with play. Therefore, this long basket strut 19 lies on the short floor profile 15. The long basket strut 19 is secured at its inserted end with play using a cotter pin 21. The three parts of the annealing basket are therefore equipped with a certain mobility in the assembled state, through which the stability of the basket is not negatively influenced and the basket may manage tensions during the heat treatment and dynamic loads well.

Figure 8:
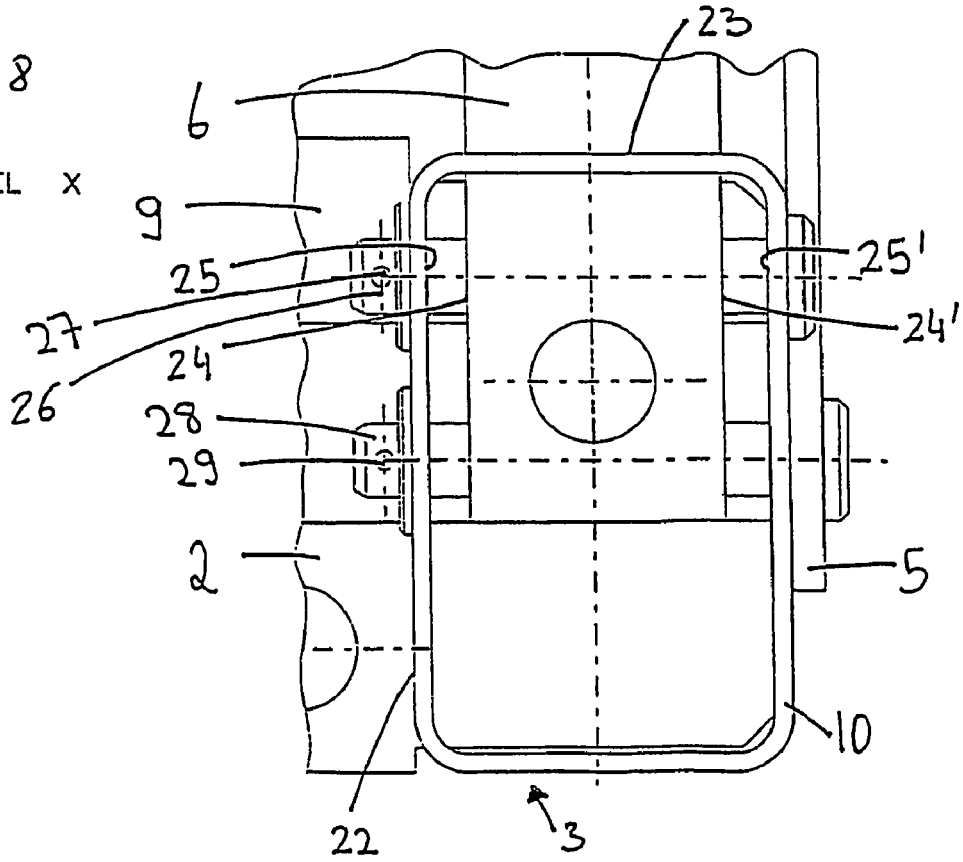
FIG. 8 shows a detail view x of the plug-in connection of the rest profile/corner supports of the annealing element.

The detail x from FIG. 1 is shown enlarged in FIG. 8. The plug-in connection of three parts of the annealing rack element is recognizable here.

Using this plug-in connection, a long rest profile 10 is detachably connected to a short rest profile 2 of the rest 3 and to a corner support 6. In this case, each of the three parts is oriented perpendicularly to each of the two other parts.

The long rest profile 10 is implemented having a greater height than the short rest profile 2. The long rest profile 10 has a first hole 22, in which a short rest profile 2 is inserted, in the region of one end, but at a distance thereto on the side facing toward the interior of the rest 3.

The long rest profile 10 has a second hole 23 in the region of one end, but at a distance thereto. This second hole 23 is applied to the upper face of the long rest profile 10. The basket support 6 is inserted through this second hole 23. Its lower end comes to rest on the short rest profile 2, which is also inserted.

Two diametrically opposite retaining holes 24 and 24' are positioned in the region of the lower end of the corner support 6, but at a distance to this end. At the same height, the long rest profile 10 also has a retaining hole 25 and 25' on each side. The retaining holes 24, 24' and 25, 25' in the long rest profile 10 and in the corner supports 6 are positioned flush. A retaining bolt 26 is inserted parallel to the longitudinal axis of the inserted short rest profile 2 through these retaining holes 24, 24', 25, and 25'. The retaining bolt 26 is secured using a retaining cotter pin 27.

The strut bolt 28 having strut cotter pin 29 is used for the purpose of detachably connecting a rack strut 5 to the long rest profile 10 and the corner support 6. Through the retaining bolts 26 and strut bolts 28 having assigned cotter pins 27 and 29, the rest profiles 2 and 10, the corner supports 6, and the rack struts 5 are secured with play.

Figure 9:
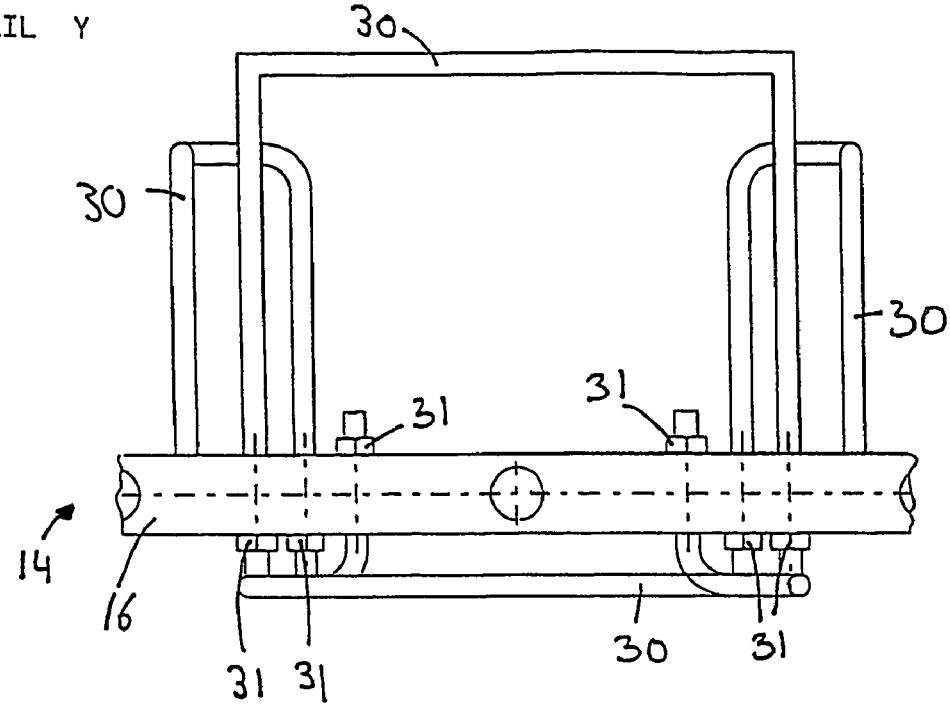
FIG. 9 shows a detail view y of the plug-in and screw connection of the wire clip to the annealing basket.

The detail y from FIG. 6 is shown enlarged in FIG. 9. In this case, the plug-in and screw connections of wire clips 30 to a long floor profile 16 of the basket floor 14 may be seen. In this case, the wire clips 30 shown are inserted into or through holes of the long floor profiles 16. The wire clips 30 inserted through are screwed onto the free ends of the wire clips 30 using self-locking nuts 31. The wire clips 30 are specially shaped. They are used for centering aluminum parts during the automatic loading and unloading procedure. The wire clips 30 are tailored to the particular aluminum component to be held. The aluminum component is not shown.

Figure 10:
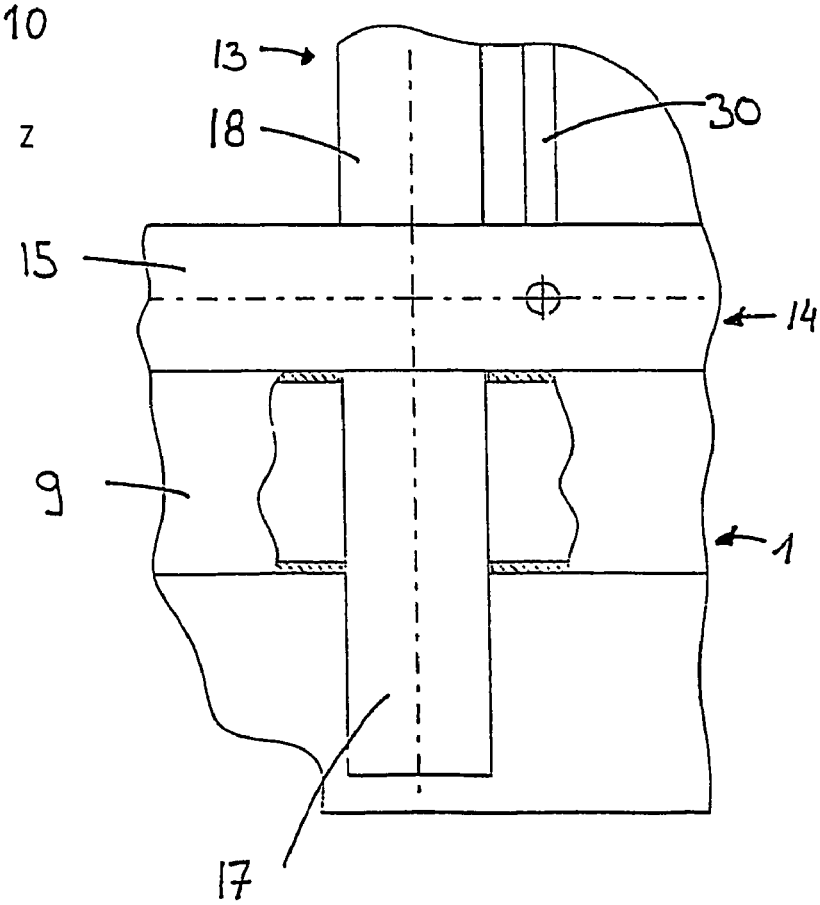
FIG. 10 shows a detail view z of the plug-in connection annealing rack element/annealing basket.

The detail z from FIG. 4 is shown enlarged in FIG. 10. In this case, a plug-in connection for fixing an annealing basket 13 on the annealing rack element 1 is shown.

For this purpose, the positioning profile 9 of the annealing rack element is provided with two diametrically opposite square holes 12 on its top and bottom in such a way that a basket support 1 of an annealing basket 13 may be inserted through. In this case, the basket support 18 of the annealing basket 13 is implemented as a vertical hollow profile, whose diameter is slightly smaller than the diameter of the two holes 12. In the state inserted through, regions of the basket floor 14 lie directly on the upper side of the positioning profile 9.

The use of the low-distortion annealing rack according to the present invention is to be explained in the following on the basis of an example:

The annealing baskets are charged with the stock to be treated, particularly aluminum cast parts for the automobile field. The charging is typically performed automatically. For this purpose, the baskets are already in the annealing rack element or are raised therein after charging. Baskets which are only self-supporting in the empty state, but not with annealing stock inserted, are generally used. Even annealing stock having very complicated geometry may be fixed well by the wire clips. The advantage of this division is that these baskets may be adapted easily to the components and the simply designed, stable annealing rack elements assume the supporting function. After an automatic stacking of this type of multiple annealing rack elements, the annealing rack is introduced into the furnace via transport rollers or transport chains. For this purpose, the annealing rack has an at least largely planar bottom. The stock is now annealed in the furnace. Subsequently, it is immersed in a quenching basin which is filled with water, then removed from the basin and made available for further treatment. The individual treatment stages in the furnace and subsequently in the quenching basin are automated in such a way that automatic recognition units determine the current position of the annealing rack and gripping units may grip exactly. The annealing rack may also not have any deformations, so that these positions may be detected correctly.

LIST OF REFERENCE NUMBERS

1 annealing rack element
2 short rest profile of the rest 3
3 rest of the annealing rack element 1
4 holes in the short rest profile 2
5 rack strut
6 corner support
7 centering tip9
8 transport switching flag
9 positioning profile
10 long rest profile of the rest 3
11 holes in the long rest profile 10
12 square holes in the positioning profile 9
13 annealing basket
14 basket floor
15 short floor profiles
16 long floor profiles
17 identification switching flag
18 basket support
19 long basket strut
20 rectangular hole in the short floor profile 15
21 cotter pin for long floor profile 16
22 first hole in the long rest profile 10
23 second hole in the long rest profile 10
24 retaining hole in the corner support 6
24' retaining hole in the corner support 6
25 retaining hole in the long rest profile 10
25' retaining hole in the long rest profile 10
26 retaining bolt
27 retaining cotter pin
28 strut bolt
29 strut cotter pin
30 wire clip
31 nut

The invention claimed is:

1. An annealing rack comprising at least one annealing rack element and at least one annealing basket, which is removably placed in the at least one annealing rack element and the shape of the at least one annealing basket is designed for a particular annealing stock, wherein each of the at least one annealing rack element has at least one rest and corner supports projecting upward from corners of the at least one rest, and wherein the at least one rest and the corner supports are connected to one another with play.

2. The annealing rack according to claim 1, wherein the at least one annealing rack element is implemented so that the at least one annealing rack element is stackable one on top of another.

3. The annealing rack according to claim 1, wherein in the at least one annealing rack element, the corner supports are connected to the at least one rest and/or to one another using rack struts.

4. The annealing rack according to claim 1, wherein the at least one rest and the corner supports are detachably connected to one another.

5. The annealing rack according to claim 1, wherein the at least one annealing rack element is provided with means for detachable fixing of the at least one annealing basket.

6. The annealing rack according claim 1, wherein the at least one annealing basket has a basket floor having upwardly projecting basket supports.

7. The annealing rack according to claim 6, wherein in the at least one annealing basket, the basket supports are connected to the basket floor and/or to one another using basket struts.

8. The annealing rack according to claim 6, wherein the basket floor and the basket supports are connected to one another detachably.

9. The annealing rack according to claim 6, wherein the basket floor and the basket supports are connected to one another with play.

10. The annealing rack according to claim 6, wherein wire clips are attached detachably to the basket floor and/or the basket supports and/or the basket struts.

11. The annealing rack according to claim 1, wherein the at least one-annealing basket is provided with means for detachable fixing on the at least one annealing rack element.

12. The annealing rack according to claim 1, wherein the at least one rest, the corner supports, and the rack struts of the at least one annealing rack element are detachably connected to one another.

13. The annealing rack according to claim 6, wherein the basket floor, the basket supports, and the basket struts of the at least one annealing basket are connected to one another detachably.

14. The annealing rack according to claim 6, wherein the basket floor, the basket supports, and the basket struts of the at least one annealing basket are connected to one another with play.

15. An annealing rack comprising at least one annealing rack element and at least one annealing basket, which is removably placed in the at least one annealing rack element and the shape of the at least one annealing basket is designed for a particular annealing stock, wherein each of the at least one annealing rack element has at least one rest and corner supports projecting upward from corners of the at least one rest, in the at least one annealing rack element, the corner supports are connected to the at least one rest and/or one another using rack struts, and the at least one rest, the corner supports, and the rack struts of the at least one annealing rack element are connected to one another with play.

* * * * *